United States Patent [19]

Carabillo

[11] Patent Number: 5,067,176

[45] Date of Patent: Nov. 26, 1991

[54] SELF-ADJUSTING TROUSER WAISTBAND SYSTEM

[76] Inventor: Vincent Carabillo, 90 Trenton Ave., Clifton, N.J. 07011

[21] Appl. No.: 597,839

[22] Filed: Oct. 15, 1990

[51] Int. Cl.[5] ..... A41D 1/06

[52] U.S. Cl. ..... 2/237; 2/76; 2/220

[58] Field of Search ..... 2/76, 78 C, 220, 221, 2/236, 237, 243 R, 247, 401

[56] References Cited

U.S. PATENT DOCUMENTS

| | | | |
|---|---|---|---|
| 1,812,593 | 6/1931 | Karberg | 2/78 C |
| 4,193,136 | 3/1980 | Pierce | 2/237 |
| 4,503,567 | 3/1985 | Muse | 2/76 |
| 4,583,478 | 4/1986 | Bassetti | 2/76 |
| 4,688,271 | 8/1987 | Capelle | 2/220 |
| 4,893,358 | 1/1990 | Bice | 2/76 |
| 4,970,728 | 11/1990 | D'Ambrosio | 2/76 |

FOREIGN PATENT DOCUMENTS

| | | | |
|---|---|---|---|
| 8026/32 | 7/1933 | Australia | 2/237 |
| 105372 | 10/1938 | Australia | 2/220 |
| 505052 | 8/1954 | Canada | 2/237 |
| 897536 | 10/1953 | Fed. Rep. of Germany | 2/237 |
| 2205862 | 8/1973 | Fed. Rep. of Germany | 2/237 |
| 3101728 | 8/1982 | Fed. Rep. of Germany | 2/220 |
| 1145620 | 10/1957 | France | 2/237 |
| 1262634 | 4/1961 | France | 2/237 |
| 1263757 | 5/1961 | France | 2/237 |
| 551294 | 2/1943 | United Kingdom | 2/76 |
| 1100047 | 1/1968 | United Kingdom | 2/237 |
| 1456922 | 12/1976 | United Kingdom | 2/237 |

*Primary Examiner*—Werner H. Schroeder
*Assistant Examiner*—Diana L. Biefeld
*Attorney, Agent, or Firm*—M. K. Silverman

[57] ABSTRACT

A self-adjusting trouser waistband system includes inner and outer combinations of extensible and non-extensible elements postioned respectively on and with the outside and inside of trouser pockets, such trouser pockets provided with expansible surfaces which integrally formed with innermost portions of the pockets to which the non-extensible elements are secured.

12 Claims, 1 Drawing Sheet

SELF-ADJUSTING TROUSER WAISTBAND SYSTEM

BACKGROUND OF THE INVENTION

A common problem in both male and female clothing is that the girth of the waistband is unable to adjust to changes in the girth of the wearer. Such changes generally occur as a function of time of the day, i.e., before and after meals, sitting versus standing, bending versus standing, ambient temperature, and time related metabolic changes of the wearer.

In general, it is necessary for the user to alter the waistband or change one's belt setting when such changes occur. Typically, adjustments of plus or minus about one inch are all that is possible in prior art trousers. Further, even within such adjustment capability, a visible distortion in the appearance of the waistline and trousers, particularly in the vicinity of the pockets thereof, may be noticed.

The only prior art attempt to deal with problems of the above nature, known to the inventor herein, lies is in the use of so-called tongue and buckle elements. Where such tongue-and-buckle elements are employed, a larger range of adjustability in the girth of a trouser becomes possible. However, the tongue-and-buckle system requires the use of externally visible hardware which, in addition to their aesthetic drawbacks, are difficult to clean and are subject to malfunction, particularly as the tongue elements wear-out. Also, the use of buckles to the left and right side of one's trousers is uncomfortable to certain persons.

It is in response to the above needs and shortcomings of the prior art that the instant invention is directed.

SUMMARY OF THE INVENTION

The present invention relates to a self-adjusting trouser waistband system comprising a pair of trousers having a circumferential waist starting and ending at a trouser fly. The system further includes left and right trouser pockets including therein inner and outer extensible means for stretching horizontally. Also included are left and right forward linear elastic elements having first ends thereof secured to respective left and right sides of said trouser fly. The inventive system further includes left and right forward non-extensible linear elements, each of such elements having a first and second end, each first end of each of said forward non-extensible elements secured to a respective side of said trouser fly, said forward non-extensible elements secured to said outer extensible means of said pockets. The system further includes left and right rear non-extensible elements, each of said elements having first and second ends, each of said first ends secured to said second ends of said forward elastic elements, and said second end of said rear non-extensible linear elements secured to said circumferential waist of said trousers proximally to the rear of each of said pockets, said rear non-extensible elements secured to said inner extensible means of said pockets. The system yet further includes left and right rear linear elastic elements having first ends secured to said second end of said forward non-extensible elements and having second ends therein secured to said circumferential waist of the trousers at the same point that said second end of said rear non-extensible linear elements are secured to said waist.

It is, accordingly, an object of the present invention to provide a self-adjusting trouser waistband system which will permit the girth of the trousers to expand and contract in response to changes in the effective girth of the waist of the user resulting from changes of waist girth resulting from time of day, eating of meals, sitting, bending, standing, or time-dependant metabolic changes.

It is of an another object of the instant invention to provide a self-adjusting trouser waistband system which will provide a better and more naturally appearing trouser waist and trouser upper area for the wearer regardless of time of the day or physical position of the wearer.

It is a yet further object of the present invention to provide a trouser waistband system having a range of self-adjustment of between 3 and 4 inches.

The above and yet other objects and advantages of the present invention will become apparent and hereinafter set forth a Brief Description of the Drawings, Detailed Description of the Invention, and Claims appended herewith.

BRIEF DESCRIPTION OF THE INVENTION

DETAILED DESCRIPTION OF THE INVENTION

Figure 1:
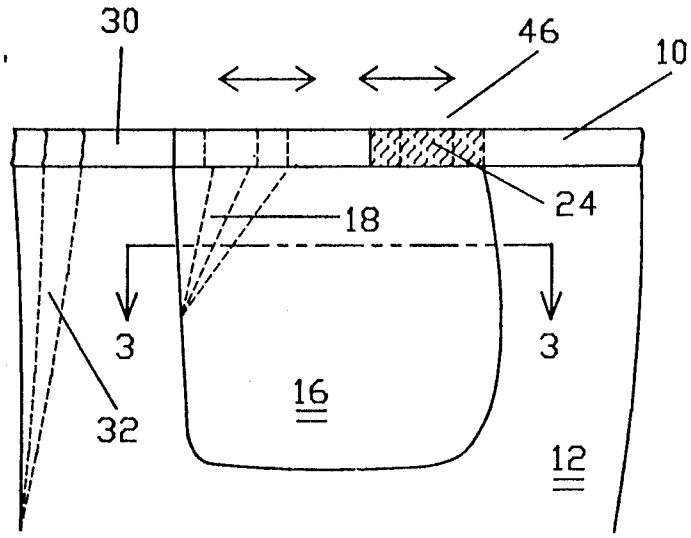
FIG. 1 is a fragmentary sectional view of a portion of a trouser waist and pocket in accordance with the instant invention.

With reference to the fragmentary schematic view of FIG. 1, the instant inventive trouser waistband system may be seen to include a circumferential waist 10 of a pair of trousers 12. It is noted that the opposite end (not shown) of waist 10 connects to the opposite side of trouser fly 14. Further, it is to be understood that the below-described structure with respect to the left side of the trouser is in all respects identical and symmetric to the same structure employed at the right side of the trouser.

Figure 2:
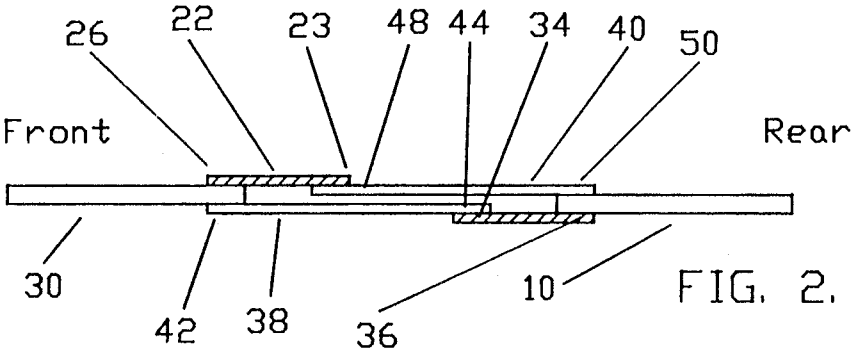
FIG. 2 is a top view of the subject matter of FIG. 1.

With further respect to the views of FIGS. 1 and 2, there is shown therein a left pocket 16 which is provided with extensible means 18 located within outer and inner surfaces 19 and 21 respectively of pocket 16. Means 18 provide for horizontal stretching of said pocket 16. Extensible means 18 are formed integrally within pocket 16. It is to be appreciated that such extensible means 18 may exist in a variety of possibly configurations, including simple slits within the pocket. However, in all respects, said means 18 must integrally interface with lower portions of a forward non-extensible element 38 (see FIG. 2) and a rear linear non-extensible element 40. In practical implementation, said rear linear non-extensible element 40 will interface with inner surface 21 of the outside of pocket 16 (see FIG. 3), while forward element 38 will interface with extensible means 18 formed within the outer surface 19 of pocket 16. However, in certain other embodiments the non-extensible elements may be oppositely secured relative to the inside and outside surfaces of the pockets.

As may be noted in the top view of FIG. 2, a forward linear elastic element 22 exhibits a first end 26 and second end 28, in which said first end 28 is secured to area 30 of the trousers which is that area to which fly 14 adjoins.

It is to be noted also that in FIGS. 1 and 2 there is shown a fly region extensible means 32 which may optionally employed in the inventive system to yet further enhance the range of expandability of the resultant invention. Where fly region extensible means 32 is employed, area 30 connects thereto, which, as above noted, connects to first end 26 of forward elastic element 22.

With further respect to FIGS. 1 and 2, it is seen that a rear elastic element 24, comprises a first end 34 and a second end 36.

Said forward non-extensible element 32 exhibits a first end 42 and a second end 44. It is noted that said first end 42 thereof is secured to fly area 30 at substantially the same point that first end 26 of forward elastic element 22 is so secured such that, effectively, said first end 42 of forward non-extensible element 38 is secured to the waist in the area 30 of the fly of the trouser at the same point that said forward end 26 of the said first elastic element 22 is so secured.

The second end 44 of forward non-extensible element 38 is secured to first end 34 of rear elastic element 24, while second end 36 of said rear elastic element is secured to the trouser waist 10 at a point 46 (see FIG. 1) which is at the rear of pocket 16.

With respect to rear non-extensible linear element 40, said element is seen to exhibit a first end 48 and a second end 50. Said first end 48 is secured to second end 28 of forward elastic element 22 while said second end 50 of rear non-extensible element 40 is secured to trouser waist 10 at substantially the same point 46 as said second end 36 of said rear elastic element is secured to said waist 10.

Figure 3:
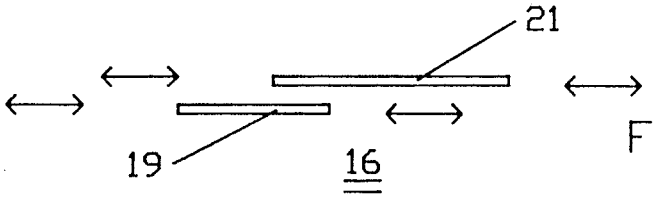
FIG. 3 is cross-sectional view taken along line 3—3 of FIG. 2.

As may be noted in the views of FIG. 2 and 3, the resultant system is one which may selectably expand, responsive to changes in the girth of the wearer, in the directions shown by the arrows. More particularly, it is seen that trouser fly area 30, forward elastic element 22, rear non-extensible element 40 and pocket surface 21 comprise a first unitary expansible subsystem while the combination of trouser fly area 30, forward non-extensible element 38, pocket surface 19 and rear elastic element 24 comprise a second unitary expansible subsystem. It is the dynamic co-action of said subsystems which enables the instant invention. It has been found that the location of said above described subsystems of elements 21, 22 and 40 at the inward side of the pocket, adjacent to the body of the user, and of said elements 19, 24 and 38 at the outside of the pocket, result in a remarkable self-adjustability of the pocket and waist area of the trousers to changes of the girth of the user resultant from any cause, with a range of up to four inches.

Figure 4:
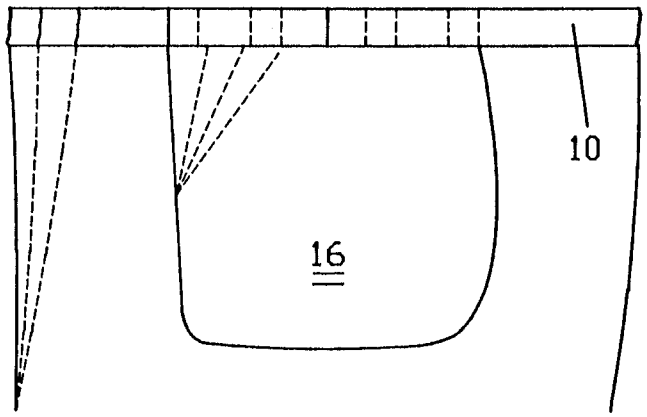
FIG. 4 is a view, similar to the view of FIG. 1, of a second embodiment of the instant invention.
Figure 5:
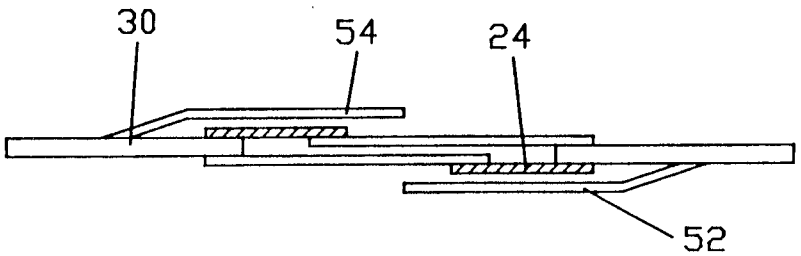
FIG. 5 is a top view of the subject matter of FIG. 4.

An alternate embodiment of the instant invention is shown in the views of FIGS. 4 and 5. Said embodiment is substantially the same as that above described with reference to FIGS. 2 and 3 except that there are provided cosmetic curtains 52 and 54. The purpose of which is to cover elastic elements 22 and 24. It is to be appreciated that said curtains are circumferential in character and thereby, in the view of FIG. 4, would completely surround any portion of the elastic elements that would otherwise be visible. In other respects, the embodiment of FIGS. 4 and 5 is the same in structure and function as is the embodiment of FIGS. 1 to 3.

It is to be appreciated that the above described system may be integrated into both male and female clothing and, in given applications, the position of the pocket may be changed and, in certain applications, only one pocket may be employed.

Accordingly, while there has been shown and described the preferred embodiment of the instant invention it is to be appreciated that the invention may be embodied otherwise as herein specifically shown and described and that, within said embodiment, certain changes may be made within the form and arrangement of the parts without departing from the underlying invention as said forth in the claims appended herewith.

Having thus described my invention, what I claim as new, useful and non-obvious and, accordingly, secure by letters of patent of the United States of America is:

1. A self-adjusting trouser waistband system, comprising:

(a) a pair of trousers having a circumferential waist having respective ends starting at respective opposite sides of a trouser fly;

(b) left and right pockets, including therein extensible means near the tops thereof, for stretching horizontally, said means located within both an outside surface of said pocket and an inside surface of said pocket;

(c) left and right forward linear elastic elements each having first and second ends, said first ends secured to respective opposite side areas of said trouser fly;

(d) left and right forward non-extensible linear elements, each having first and second ends, each first end of said forward linear elements secured in the area of said trouser fly, lower portions of each of said forward non-extensible elements secured to said outer surface extensible means of said pocket;

(e) left and right rear non-extensible linear elements, each having first and second end, each of said first ends secured to said second ends of said forward elastic elements, and said second end secured to said circumferential waist of the trousers at a region proximal to the rear of each pocket, lower portions of each of said rear non-extensible elements secured to said inner surface extensible means of said pocket; and (f) left and right rear linear elastic elements having first and second ends, said first ends secured to said second ends of said forward non-extensible elements and said second ends secured to said circumferential trouser waist in said region of the rear of each pocket, whereby the horizontal dimension of said trouser waist and pocket areas will expand and contract in response to changes in the effective girth of the waist of the user resulting from changes of girth resulting from eating of meals, time of day, sitting, bending, standing and other causes.

2. The system as recited in claim 1 further comprising:

left and right waistband curtains proportioned to the circumferentially surround said rear elastic elements so as to hide the same from external view.

3. The system as recited in claim 2 further comprising:

left and right waistband curtains proportioned to the circumferentially surround said rear elastic elements so as to hide the same from external view.

4. The system as recited in claim 1 in which said trouser fly area includes extensible means having interface with the zipper parts of said trouser fly.

5. The system as recited in claim 2 in which said trouser fly area includes extensible means having interface with the zipper parts of said trouser fly.

6. The system as recited in claim 3 in which said trouser fly area includes extensible means having interface with the zipper parts of said trouser fly.

7. A self-adjusting trouser waistband system, comprising:

(a) a pair of trousers having a circumferential waist having respective ends starting at respective opposite sides of a trouser fly;

(b) left and right pockets, including therein extensible means near the tops thereof, for stretching horizontally, said means located within both an outside surface of said pocket and an inside surface of said pocket;

(c) left and right forward linear elastic elements each having first and second ends, said first ends secured to respective opposite side areas of said trouser fly;

(d) left and right forward non-extensible linear elements, each having first and second ends, each first end of said forward linear elements secured in the area of said trouser fly, lower portions of each of said forward non-extensible elements secured to said inner surface extensible means of said pocket;

(e) left and right rear non-extensible linear elements, each having first and second end, each of said first ends secured to said second ends of said forward elastic elements, and said second end secured to said circumferential waist of the trousers at a region proximal to the rear of each pocket, lower portions of each of said rear non-extensible elements secured to said outer surface extensible means of said pocket; and (f) left and right rear linear elastic elements having first and second ends, said first ends secured to said second ends of said forward non-extensible elements and said second ends secured to said circumferential trouser waist in said region of the rear of each pocket, whereby the horizontal dimension of said trouser waist and pocket areas will expand and contract in response to changes in the effective girth of the waist of the user resulting from changes of girth resulting from eating of meals, time of day, sitting, bending, standing and other causes.

8. The system as recited in claim 7 further comprising:

left and right waistband curtains proportioned to the circumferentially surround said rear elastic elements so as to hide the same from external view.

9. The system as recited in claim 7 further comprising:

left and right waistband curtains proportioned to circumferentially surround said rear elastic elements so as to hide the same from external view.

10. The system as recited in claim 7 in which said trouser fly area includes extensible means having interface with the zipper parts of said trouser fly.

11. The system as recited in claim 9 in which said trouser fly area includes extensible means having interface with the zipper parts of said trouser fly.

12. The system as recited in claim 9 in which said trouser fly area includes extensible means having interface with the zipper parts of said trouser fly.

* * * * *